US006391840B1

(12) United States Patent
Thompson et al.

(10) Patent No.: US 6,391,840 B1
(45) Date of Patent: May 21, 2002

(54) MULTIPLE COMPONENT BLEACHING COMPOSITIONS

(75) Inventors: Katherine Mary Thompson; David William Thornthwaite, both of Bebington (GB)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/547,807

(22) Filed: Apr. 11, 2000

(30) Foreign Application Priority Data

Apr. 12, 1999 (GB) ..... 99302821

(51) Int. Cl.[7] ..... C11D 3/395; C11D 17/00
(52) U.S. Cl. ..... 510/376; 510/372; 510/375
(58) Field of Search ..... 510/376, 375, 510/372

(56) References Cited

U.S. PATENT DOCUMENTS 3,760,986 A * 9/1973 Castner et al. ..... 222/137

FOREIGN PATENT DOCUMENTS

| | | | |
|---|---|---|---|
| EP | 0 744 465 | * | 11/1996 |
| JP | 60038497 | * | 2/1985 |
| WO | WO 95/16023 | * | 6/1995 |
| WO | WO 97/31087 | * | 8/1997 |
| WO | WO 98/23533 | * | 6/1998 |
| WO | WO 98/23717 | * | 6/1998 |

* cited by examiner

*Primary Examiner*—Yogendra N. Gupta
*Assistant Examiner*—John M Petruncio

(57) ABSTRACT

The invention provides liquid bleaching compositions comprising multiple partial compositions held separately from each other in a multiple compartment container. One partial composition comprises a peroxygen bleach compound, preferably hydrogen peroxide. One partial composition (which may be the same as the one containing the peroxygen compound) comprises an imine or oxaziridine bleach activator compound. One partial composition, which is different from the one containing the bleach activator, comprises an alkaline compound in amount sufficient to raise the pH of the total composition to a value at which the bleach system is effective.

The bleach activator compound is preferably a sulfonimine or a quaternary imine salt.

The number of partial compositions and of the compartments in the container is preferably 2.

20 Claims, No Drawings

MULTIPLE COMPONENT BLEACHING COMPOSITIONS

FIELD OF THE INVENTION

The invention relates to liquid bleaching compositions consisting of at least two partial compositions which are stored separate from each other in a single container comprising at least two chambers, and which are mixed on use, one partial composition comprising a peroxygen bleach compound.

BACKGROUND OF THE INVENTION

In household and fabric cleaning and in many other areas there is a need for agents which bleach unsightly stains on surfaces or fabric and/or disinfect surfaces. Common agents for this purpose are those which contain active chlorine, the most common being sodium hypochlorite, which is widely used in cleaning compositions to decolourise soils or stains, remove mould stains, assist in cleaning through reaction with soils and to kill microorganisms.

One problem with said compositions is that hypochlorite has an unpleasant odour and, when accidentally mixed with an acidic product can liberate toxic amounts of chlorine gag. Therefore there is a need for alternative bleaching agents.

Other bleaching agents are known, particularly many kinds of peroxygen bleaching compounds such as peracids and their salts and peroxides. However, the bleaching power of peroxygen bleaching compounds as such generally falls short of that of hypochlorite and therefore they are often used in conjunction with oxygen transfer or bleach activator agents. Such agents generally operate by reacting with the peroxygen bleach compound to form an oxidative bleaching species which subsequently reacts with the substrate to be bleached, cleaned or disinfected.

Peroxygen bleaching compounds, like hypochlorite, are most effective at alkaline pH, particularly at pH 9 and above.

Recently, imine compounds wherein the nitrogen is relatively electron deficient have been disclosed to be very efficient bleach activator agents, as are the corresponding oxaziridines. Typical examples of such compounds are the sulfonimines and sulphonyloxaziridines, such as disclosed in U.S. Pat. Nos. 5,045,223, 5,041,232 and 5,047,163, (=EP-A-0 446 982) and the quaternary imine salts (imine quats) and quaternary oxaziridine salts, such as disclosed in U.S. Pat. Nos. 5,360,568, 5,360,569, 5,478,357 and WO 95/13351. These imine and oxaziridine compounds have all been shown to be good oxidants in combination with a large variety of peracids and peracid precursors. Additional examples of imine quats are described in WO 97/10323, WO 98/16614 and U.S. Pat. No. 5,710,116. All these documents exemplify the efficiency of the imine compounds by adding them to alkaline solutions of a standard washing powder, immediately followed by washing standard pieces of stained cloth in the wash liquor thus obtained. However, these documents do not contain any long term stability data of detergent products containing imine compounds.

In WO 96/40855 bleach systems are described comprising sulfonimines and imine quats, hydrogen peroxide and transition metal catalysts. The compositions are broadly described as being useful for cleaning and bleaching fabrics and household hard surfaces. Again the bleaching power is described by admixing imine compound and hydrogen peroxide with a solution of a powdered laundry detergent followed by washing pieces of stained cloth, and again no long term stability data bleaching products containing the imine compounds are given.

WO 98/23717 discloses that bleaching systems containing a peroxyacid or a peroxyacid precursor system such as TAED/perborate in combination with an imine quat have limited efficiency at high pH because of instability of the oxidising species formed by reaction of the peroxyacid with the imine quat. It is further disclosed in this document that this problem may be solved by using hydrogen peroxide (or a compound generating hydrogen peroxide on contact with water) instead of a peroxyacid. In the examples it is shown that freshly prepared solutions of hydrogen peroxide and imine quat do indeed clean soiled household hard surfaces better and can be used at higher pH than freshly prepared solutions of peracids and imine quat. However, again no long term stability data of such products are given.

Most laundry detergent products containing bleach are sold as solids and the same holds for most machine dish wash products. In such products long term storage stability of bleach activators in combination with other components of the product is of limited relevance because of the very limited possibility of chemical reactions between the components of the product.

Household hard surface cleaning products, on the other hand, are generally aqueous liquids and the same holds for specialized laundry bleaching products. In such products chemical incompatibility of the various components may be a problem which can limit long term storage stability. Therefore in liquid cleaning compositions containing a peroxygen bleach compound and an imine bleach activator long term storage stability may be a problem, particularly at the alkaline pH at which peroxygen bleach compounds show their greatest activity.

For various products containing peroxygen compounds the problem of storage stability of the peroxygen compound itself has been solved by storing the peroxygen compound separately from an alkaline component whereupon the two components are mixed just before use. Thus, toothpastes and peroxide-based hair bleaching compositions have been formulated as weakly acidic peroxide solutions or gels which are mixed with separate weakly alkaline solutions or pastes just before use. The known advantage of this form of product is that under acidic conditions the peroxide is more stable to decomposition, but is more effective as a bleaching agent under alkaline conditions.

Other two-part peroxide based compositions are disclosed in JP-A-60/038497 (LION BRANDS), which relates to a foaming, two-part drain cleaning composition which comprises:

a) 0.5–50% wt hydrogen peroxide, b) alkali, having an alkalinity 0.1–50% based on sodium hydroxide, c) surface active agent in (a) or (b), and, d) terpene alcohol/cyclic terpene alcohol in (a) or (b).

The compositions (a) and (b), including the surfactants and terpene are sequentially or simultaneously dosed into a toilet bowl and pass into the drains where the composition produces a body of foam which acts to clean or if necessary unblock the drain.

Other forms of simultaneous delivery of two components are known. Thus, U.S. Pat. No. 3,760,986 discloses a dispensing bottle for dispensing two separate fluids to a common point. Such a bottle is formed with an opening at the top and a divider extending through the interior of the bottle to define two compartments which provide dual reservoirs for fluids. The apparatus disclosed further comprises a pump means to simultaneously withdraw fluid from each compartment, via separate draw tubes, and discharge the fluid to a common point. This device enables an alkaline and an acid material to be stored separately and sprayed from a single unit to a common point.

WO 95/16023 discloses a container comprising two chambers or reservoirs, one containing a liquid acid or neutral composition comprising a peroxide compound and the other containing a liquid alkaline composition. The container is provided with a spray system able to either produce a single spray of a mixture of the two components or two simultaneous sprays of each component directed to the same point on a surface whereafter the components mix on the surface.

WO 97/31087 discloses a container comprising two chambers or reservoirs, one containing a liquid composition comprising a peroxygen bleach and the other containing a liquid composition comprising a builder or chelating agent and at least one of these liquids containing a pH adjusting agent which on mixing of the liquids brings the pH of the mixture to a value at which the peroxygen bleach is effectively cleaning as well as stable. Preferably the peroxygen bleach is either a peracid or a persalt and the pH is between 9.0 and 11.5. The two liquid compositions are mixed on delivery to the surface, preferably by a spray system.

None of these documents adresses the problem of long term stability of imine and oxaziridine bleach activators in the presence of peroxygen bleach compounds and/or at alkaline pH.

BRIEF DESCRIPTION OF THE INVENTION

It is therefore an object of the present invention to provide liquid bleaching and cleaning compositions which comprising a peroxygen bleach compound and an imine or oxaziridine bleach activator compound which are stable on storage and give good bleaching and cleaning.

It is another object of the invention to provide liquid bleaching and cleaning compositions comprising a peroxygen bleach compound and an imine or oxaziridine bleach activator which can be used at the pH at which the combination of bleach and bleach activator is effective.

It is a further object of the invention to provide liquid bleaching and cleaning compositions in which components which are not storage stable in the presence of each other are held separate until the time of dispensing of the composition on the substrate to be bleached/cleaned.

Hereinafter the phrases 'clean' and 'cleaning' will also comprise 'bleach' and 'bleaching'.

It has now been found that although imine and oxaziridine bleach activators are not stable at high pH, they are stable, whether or not in the presence of peroxide bleach compounds, at low pH and can be stored for long periods without appreciable decomposition. On the other hand, combinations of peroxide bleach compounds and imine or oxaziridine bleach activators only show useful bleaching activity at alkaline pH.

Accordingly, the invention provides liquid cleaning compositions consisting of at least two liquid partial compositions which are held separate from each other in a single container comprising at least two chambers or reservoirs or compartments (hereinafter referred to as 'chambers') wherein at least one partial composition comprises a peroxygen bleach compound, at least one partial composition comprises an imine or oxaziridine bleach activator compound and at least one partial composition other than that comprising the imine or oxaziridine bleach activator compound comprises a alkaline pH adjusting compound which on mixing of the partial compositions is able to raise the pH of the final composition to a value at which the combination of bleach and bleach activator is effective. Each partial composition has a pH such that the components of that partial composition are stable on storage.

Furthermore the invention provides liquid cleaning compositions obtained through mixing of two or more partial compositions, at least one partial composition comprising a peroxygen bleach compound, at least one partial composition comprises an imine or oxaziridine bleach activator compound and at least one partial composition other than that comprising the imine bleach activator compound comprises a alkaline pH adjusting compound, each partial composition having a pH such that the components of that partial composition are stable on storage, the final composition having a pH suitable for effective cleaning.

Also, the invention provides a container comprising two or more chambers holding the liquid partial compositions described above.

DETAILED DESCRIPTION OF THE INVENTION

For the purposes of this invention a 'partial composition' is defined as a component, or a mixture of more, but not all, components of the final composition, which component or mixture is held in a separate chamber of the container containing the total composition. Two or more partial compositions together make up the final cleaning composition according to the invention.

A container suitable for holding the cleaning compositions according to the invention has at least as many separate chambers as the number of partial compositions making up the total composition. Such container may have one outer wall embracing all chambers which are separated from each other by portion walls inside the container or, alternatively, it may be made up of a plurality of separate containers, equivalent to the chambers, which are held together by some external means, such as a connecting part of the walls or an adhesive sleeve surrounding them, in such a way that they can be held and handled as one container. A dispensing system is provided in that each chamber is provided with an outlet opening through which the partial composition is dispensed. These outlet openings may all lead to a separate mixing chamber in which the dispensed amounts of the partial compositions mix just before being applied to the surface through a dispensing opening in the mixing chamber. Alternatively, the outlet openings may all lead to the outside of the container in such a way that the dispensed amounts of the partial compositions are all applied simultaneously to the same area of the surface so as to mix while being applied to the surface or immediately after application on the surface. To this end the outlet openings will generally be positioned in close proximity to each other such that all partial compositions are poured, squirted or sprayed onto the same area of the surface in one action. The outlet openings may be provided with a nozzle system designed to further improve the mixing of the partial components on leaving the container. Alternatively, the container may be provided with a multiple spray system able to either produce a single spray of a mixture of all the partial compositions or simultaneous sprays of each partial composition directed to the same area of a surface whereafter the partial compositions mix on the surface.

For practical reasons, such as ease of construction and handling, the container preferably comprises no more than two chambers each holding a partial composition which compositions together make up the final cleaning composition according to the invention. This implies that for the same reasons the cleaning compositions according to the invention are preferably made up of two partial compositions. Additionally the container may comprise a mixing chamber as outlined above.

The amounts of the partial compositions making up the final composition need not necessarily all be equal as long as care is taken that the concentration of each component in each of the partial compositions is chosen such that on mixing of the envisaged amounts of the partial compositions the right concentration of each component is present in the final composition. The volume of each chamber of the container is adapted to the amount of the partial composition contained in that chamber which is required to make up the total amount of the final composition. The total liquid volume of the final composition to be obtained from the container in general will be about equal to the total volume of the container, excluding the volume of the mixing chamber, if present.

The dispensing or outlet openings or other dispensing means of the various chambers in the container are dimensioned such that one single dispensing action dispenses the right amounts of all partial compositions necessary to properly make up the final in which each component is present in the required concentration. The dispensing or spray system may be so dimensioned that the final composition is dispensed as a foam.

Although there is no theoretical limitation as to the size and shape of the containers, for practical purposes, such as ease of handling and dispensing, the containers will generally have a total volume of 0.1–2 liters, preferably at least 0.25 l, but preferably not more than 1.5 l. Also for practical purposes two-chamber containers preferably have chambers of about equal volume, holding about equal amounts of each of the two partial compositions.

Suitable containers have been described in the co-pending British patent application numbers: 98 15659.9, 98 15660.7 and 98 15661.5.

The peroxygen bleach compound may be any peroxide or peroxide generating system known in the art. Well known examples are: hydrogen peroxide, various organic or inorganic peracids e.g. perbenzoic acid and substituted perbenzoic acids, various aliphatic peroxy acids and diperoxyacids such as peracetic acid, diperoxy-dodecanedioic acid, N,N-phthaloylamino-peroxycaproic acid (PAP), various organic or inorganic persalts such as monoperoxosulphates, perborates, perphosphates, persilicates, etc. Some of theme inorganic peroxygen compounds, such as the perborates, are known to generate peracetic acid if combined with the right precursor such as TAED.

Preferred peroxygen bleach compounds are hydrogen peroxide, peracetic acid, PAP and alkali metal or alkaline earth metal monoperoxosulphate salts. Hydrogen peroxide is particularly suitable. The amount of peroxygen compound is preferably chosen such that the final composition will contain 0.05–5% active oxygen, more preferably 0.1–3%, most preferably at least 0.5%.

The partial composition containing the peroxygen compound has a pH at which the peroxygen compound is storage stable. Many peracids and persalts have limited stability in alkaline solutions and therefore a partial composition containing these will preferably have a pH of at most 8, more preferably at most 7.5, most preferably at most 7. Hydrogen peroxide is reasonably stable up to pH 10, although for longer term stability the pH should preferably not exceed 9.5, more preferably be at most 9.0, most preferably be at most 8.0.

The imine and oxaziridine bleach activator compounds used in the compositions according to the invention are preferably chosen from: the sulfonimines disclosed in U.S. Pat. Nos. 5,041,232 and 5,047,163, (=EP-A-0 446 982), the sulphonyloxaziridines disclosed in U.S. Pat. No. 5,045,223, the quaternary imine salts (imine quats) disclosed in U.S. Pat. Nos. 5,360,568, 5,360,569 and 5,478,357, and the quaternary oxaziridinium salts disclosed in WO 95/13351. Additional useful imine quats are described in WO 96/34937, WO 97/10323, WO 98/16614 and U.S. Pat. No. 5,710,116. All these patent and patent application documents are incorporated herein by reference.

The Sulfonimines have the general structure I below:

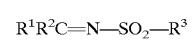

$$R^1R^2C{=}N{-}SO_2{-}R^3$$

wherein:

$R^1$ may be hydrogen or a substituted or unsubstituted phenyl, aryl, heterocyclic, alkyl or cycloalkyl group;

$R^2$ may be hydrogen or a substituted or unsubstituted phenyl, aryl, heterocyclic, alkyl or cycloalkyl group or a keto, carboxylic, carboalkoxy or $R^1C{=}N{-}SO_2{-}R^3$ group;

$R^3$ may be a substituted or unsubstituted phenyl, aryl, heterocyclic, alkyl or cycloalkyl group or a nitro, halo or cyano group;

$R^1$ with $R^2$ and/or $R^2$ with $R^3$ may respectively form a cycloalkyl, heterocyclic or aromatic ring system.

Preferred sulfonimines are particularly described in EP-A-0 446 982.

The sulphonyl-oxaziridines have the general structure II below:

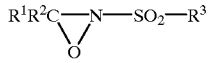

wherein:

$R^1$ may be hydrogen or a substituted or unsubstituted phenyl, aryl, heterocyclic, alkyl or cycloalkyl group;

$R^2$ may be hydrogen or a substituted or unsubstituted phenyl, aryl, heterocyclic, alkyl or cycloalkyl group or a keto, carboxylic, carboalkoxy or $R^1C{=}N{-}SO_2{-}R^3$ group;

$R^3$ may be a substituted or unsubstituted phenyl, aryl, heterocyclic, alkyl or cycloalkyl group or a nitro, halo or cyano group;

$R^1$ with $R^2$ and/or $R^2$ with $R^3$ may respectively form a cycloalkyl, heterocyclic or aromatic ring system.

Preferred sulphonyl-oxaziridines are particularly described in U.S. Pat. No. 5,045,223.

The imine quaternary salts have the general structure III below:

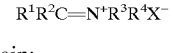

$$R^1R^2C{=}N^+R^3R^4X^-$$

wherein:

$R^1$ and $R^4$ may be hydrogen or substituted or unsubstituted phenyl, aryl, heterocyclic, alkyl or cycloalkyl groups;

$R^2$ may be hydrogen or a substituted or unsubstituted phenyl, aryl, heterocyclic, alkyl or cycloalkyl group or a keto, carboxylic or carboalkoxy group;

$R^3$ may be a substituted or unsubstituted phenyl, aryl, heterocyclic, alkyl or cycloalkyl group or a nitro, halo or cyano group;

$R^1$ with $R^2$ and/or $R^2$ with $R^3$ may respectively form a cycloalkyl, heterocyclic or aromatic ring system.

$X^-$ is a counterion which is stable in the presence of peroxide compounds.

Preferred imine quaternary salts are particularly described in U.S. Pat. No. 5,360,569.

The oxaziridine quaternary salts have the general structure IV below:

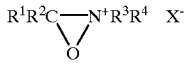

wherein:

$R^1$ and $R^4$ may be hydrogen or substituted or unsubstituted phenyl, aryl, heterocyclic, alkyl or cycloalkyl groups;

$R^2$ may be hydrogen or a substituted or unsubstituted phenyl, aryl, heterocyclic, alkyl or cycloalkyl group or a keto, carboxylic or carboalkoxy group;

$R^3$ may be a substituted or unsubstituted phenyl, aryl, heterocyclic, alkyl or cycloalkyl group or a nitro, halo or cyano group;

$R^1$ with $R^2$ and/or $R^2$ with $R^3$ may respectively form a cycloalkyl, heterocyclic or aromatic ring system.

$X^-$ is a counterion which is stable in the presence of peroxide compounds.

Preferred oxaziridine quaternary salts are particularly described in WO-A-95/13351.

The term 'substituted' as used above in relation $R^1$, $R^2$, $R^3$ and R4 in the general formulae I–IV includes nitro, halo, cyano, C1–C20 alkyl, amino, mono- or dialkyl-amino, alkylthio, alkylsulpho, keto, hydroxy, carboalkoxy, alkoxy, polyalkoxy, or quaternary ammonium groups.

Preferred bleach activator compounds in the compositions according to the invention are the sulfonimines and imine quaternary salts (imine quats). The latter are most preferred.

Particularly preferred imine quaternary salts are the 3,4-dihydroisoquinolinium salts of the general structure V below:

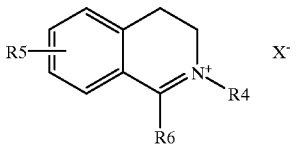

wherein R5 and R6 may represent the same groups as described for R2 above, as well as nitro, halo, cyano and alkoxy groups. R5 may represent more than one substituent in the aromatic ring. $X^-$ is a peroxide stable counterion, such as chloride, bromide, sulphate, phosphate, borontetrafluoride, $PF_6^-$, organic sulphate, p-toluene-sulphonate etc. The phenyl, aryl, heterocyclic, alkyl or cycloalkyl groups are preferably C1–C30.

Many illustrative examples of compounds according to general structure V (having one R5) are given in the table below:

| Comp. | $R^4$ | $R^5$ | $R^6$ | $X^-$ |
|---|---|---|---|---|
| 1 | $CH_3$ | H | H | $BF_4$— |
| 2 | $CH_3$ | H | H | p-tosylate |
| 3 | $CH_3$ | $CH_3$ | H | $Cl^-$ |
| 4 | $CH_3$ | $NO_2$ | H | $Br^-$ |
| 5 | $CH_3$ | Cl | H | BF4$^-$ |
| 6 | $CH_3$ | $OCH_3$ | H | brosylate$^-$ |
| 7 | phenyl | H | H | $CH_3SO_4^-$ |
| 8 | benzyl | phenyl | H | $Cl^-$ |
| 9 | $(CH_2)_2OH$ | CN | H | $PF_6^-$ |
| 10 | $CH_3$ | $CH_2COCH_3$ | H | $PF_6^-$ |
| 11 | $(CH_3)_2CH$ | $COCH_3$ | H | $CH_3CH_2SO_4^-$ |
| 12 | $CH_3$ | $SO_3^-Na^+$ | H | $Cl^-$ |
| 13 | $CH_3(CH_2)_{11}$ | H | H | p-tosylate$^-$ |
| 14 | $CH_3(CH_2)_{15}$ | Br | H | $CH_3SO_4^-$ |
| 15 | $CH_2CH_2N(CH_2)_3$ | H | H | $Cl^-$ |
| 16 | $CH_3$ | F | H | $Cl^-$ |
| 17 | $CH_3$ | $CF_3$ | H | $PF_6^-$ |
| 18 | $CH_3$ | $CH_2OPO_3Na_2$ | H | $Cl^-$ |
| 19 | $CH_3$ | $CH_2N^+(CH_3)_3$ | H | $CH_3SO_4^-$ |
| 20 | $CH_3CH_2O(CH_2)_2$ | H | H | $CH_3SO_4^-$ |
| 21 | $CH_3$ | $(CH_2)_7CH_3$ | H | $Cl^-$ |
| 22 | $CH_3$ | $CO_2^-Na^+$ | H | $Cl^-$ |
| 23 | $CH_3$ | H | phenyl | $Cl^-$ |
| 24 | $(CH_2)_7CH_3$ | H | H | p-tosylate$^-$ |
| 25 | $CH_3$ | H | $CH_3$ | $Cl^-$ |

Further illustrative examples of imine quats according to Structure V are disclosed in WO-A-97/10323, WO-A-98/16614 and U.S. Pat. No. 5,710,116.

Particularly useful are imine quats wherein R4 is an alkyl group, such as methyl, or substituted alkyl group and/or wherein R6 is hydrogen or a C1–C5 alkyl or a phenyl group. Also very useful are those compounds wherein R5 represents one or two methoxy groups, such as two methoxy groups in the 6,7 position. Examples of preferred imine quats according to formula V are N-methyl-3,4-dihydroisoquinolinium salts and the corresponding quats in which R6 are methyl or ethyl respectively. These are particularly advantageous when used in combination with hydrogen peroxide. The counterion of the imine quat is preferably an ion which is stable in the presence of peroxide compounds.

The partial composition containing the imine or oxaziridine bleach activator has pH below 8, more preferably at most 7, most preferably not above 6.5. Also the pH of this partial composition is preferable at least 2. The imine or oxaziridine bleach activators are generally present in an amount of 0.001–10%, preferably 0.01–5%, most preferably not more than 2%. The molar ratio of peroxygen compound to bleach activator in the final composition will generally range from 1500:1 to 1:2, preferably from 150:1 to 1:1, more preferably from 60:1 to 2:1.

The bleach activator compound may be a component of the same partial composition as the peroxygen compound, or they may be held separately in different partial compositions.

As outlined above, the cleaning compositions according to the invention preferably consist of two partial compositions, one of which contains the alkaline pH adjusting compound which must be held separately from the bleach activator. Thus, the other partial composition will then contain the peroxide bleach as well as the bleach activator. Such partial composition preferably has a maximum pH of 6.5, more preferably at most 6.

For ease of dipensing to the surface and also to obtain thorough mixing of the partial compositions on dispensing the partial compositions are preferably thin before mixing i.e. have a viscosity of 50 mPa or below, preferably 20 mPa or below, more preferably at most 10 mPa (Haake™ R20

Viscometer, 25° C., shear rate: 21 $sec^{-1}$). Although the viscosities of all partial compositions before mixing do not necessarily have to be equal, they are preferably not far apart, as this may influence the relative amounts of the partial compositions which are dispensed, unless the the dispensing means is properly adjusted. The final composition may be thickened if desired, preferably by a multicomponent thickening system of which the components are divided over at least two partial compositions, such that on mixing of the partial compositions on delivery to the surface to be cleaned the combination of the components of the thickening system causes the final composition to thicken. This will improve the composition's ability to cling to a non-horizontal surface and prevent it from draining off before proper cleaning is obtained. Usefully the viscosity of the final composition after dispensing is at least 50 mPa, more preferably at least 100 mPa. On the other hand the viscosity is preferably not more than 1000 mPa. (measuring conditions: see above).

A large number of multicomponent thickening systems is known in the art. For them to be suitable for the cleaning compositions according to the invention, preferably at least one component should be storage stable in the same partial composition as the peroxygen bleach compound. The total thickening system should be sufficiently stable in the final composition to enable it to thicken and remain on the surface for long enough to perform its cleaning action.

Many thickening systems have been used in thickened hypochlorite bleach compositions. Such systems often consist of two or more different detergent surfactants, or of one or more such surfactants in combination with an electrolyte such as an inorganic salt. Many thickening systems comprise as one of their components tertiary amine oxides containing one long alkyl chain e.g. having 8–22 C-atoms and two shorter alkyl chains e.g. having 1–5 C-atoms, often in combination with an anionic surfactant.

Examples of such thickening systems are described in EP-A-079697, EP-A-110544, EP-A-137551, EP-A-145084, EP-A-244611, EP-A-635568, W095/08611, DE-A-19621048 and the literature cited in these patent applications.

Other suitable thickening systems comprise polymeric substances which in solution thicken in response to an increase in pH or electrolyte concentration. Examples thereof are polymers of acrylic acid known for there thickening properties such as those sold under the trademark "Acusol".

Another way to improve cling of the final composition to a non-horizontal surface is to cause it to foam on dispensing through the addition of a foaming surfactant to at least one partial composition and the use of an appropriate dispensing device such as foaming trigger sprays known in the art.

Detergent surfactants often play an important role in thickening systems as outlined above. Apart from that they are preferably added also for their wetting properties on hard surfaces and for their cleaning properties. Thus, preferably surfactants are present even if a non-surfactant thickening system is used. If not required for thickening, the total surfactants content is preferably between 0.1 and 20%, more preferably between 0.5 and 10%, most preferably at most 7%. If part of the thickening system the minimum total amount of surfactant will be at least 0.5%, preferably at least 1%.

Surfactants may be chosen from a wide range of anionic, nonionic, cationic, amphoteric or zwitterionic surfactants well known in the art.

Suitable anionic surfactants are e.g. water-soluble salts, particularly alkali metal, alkaline earth metal and ammonium salts, of organic sulphate esters and sulphonic acids having in the molecular structure a C8–C22 alkyl radical or a C10–C22 alkaryl radical. Examples of such anionic surfactants are alcohol sulphate salts, especially those obtained from the fatty alcohols derived from the glycerides of tallow or coconut oil; alkyl-benzene sulphonates such as those having a C9–C15 Examples of such anionic detergents are alcohol sulphate alkyl group attached to the benzene ring; secondary alkanesulphonates; sodium alkyl glyceryl ether sulphates, especially those ethers of the fatty alcohols derived from tallow and coconut oil; sodium fatty acid monoglyceride sulphates, especially those derived from coconut fatty acids; salts of 1–6 EO ethoxylated fatty alcohol sulphates; salts of 1–8 EO ethoxylated alkylphenol sulphates in which the alkyl radicals contain 4–14 C-atoms; the reaction product of fatty acids esterified with isethionic acid and neutralised with sodium hydroxide.

The preferred water-soluble synthetic anionic surfactants are the alkyl benzene sulphonates, the olefin sulphonates, the alkyl sulphates, and the higher fatty acid monoglyceride sulphates. On the other hand fatty acids soaps are not very suitable for use in the cleaning compositions according to the invention.

A special class of anionic surfactants which may be used in the cleaning compositions according to the invention are hydrotropes which are known in the art specifically for their thickening or liquid structuring capabilities. Well known examples of such compounds are the alkali metal salts of toluene-, xylene- and cumene-sulphonic acid.

Suitable nonionic surfactants can be broadly described as compounds produced by the condensation of alkylene oxide groups, which are hydrophilic in nature, with an organic hydrophobic compound which may be aliphatic or alkylaromatic in nature. The length of the hydrophilic or polyoxyalkylene radical which is attached to any particular hydrophobic group can be readily adjusted to yield a water-soluble or water dispersible compound having the desired balance between hydrophilic and hydrophobic elements.

Particular examples include the condensation product of straight chain or branched chain aliphatic alcohols having 8–22 C-atoms with ethylene oxide, such as coconut oil fatty alcohol/ethylene oxide condensates having from 2 to 15 moles of ethylene oxide per mole of coconut alcohol; condensates of alkylphenols whose alkyl group contains 6–16 C-atoms with 2 to 25 moles of ethylene oxide per mole of alkylphenol; condensates of the reaction product of ethylenediamine and propylene oxide with ethylene oxide, the condensates containing from 40 to 80% of ethyleneoxy groups by weight and having a molecular weight of from 5,000 to 11,000. Other examples are: tertiary amine oxides of general structure RRRN0, where one R is a C8–C22 alkyl group (preferably C8–C18) and the other Rs are each C1–C5 (preferably C1–C3) alkyl or hydroxyalkyl groups for instance dimethyldodecylamine oxide; tertiary phosphine oxides of structure RRRP0, where one R is a C8–C22 alkyl group (preferably C8–C18) and the other Rs are each C1–C5 (preferably C1–C3) alkyl or hydroxyalkyl groups, for instance dimethyl-dodecylphosphine oxide; dialkyl sulphoxides of structure RRS0 where one R is a C10–C18 alkyl group and the other is methyl or ethyl, for instance methyltetradecyl sulphoxide; fatty acid alkylolamides; alkylene oxide condensates of fatty acid alkylolamides and alkyl mercaptans. Ethoxylated aliphatic alcohols are particularly preferred. Amine oxides are also very suitable because-they blend very well with inorganic electrolytes.

Suitable amphoteric surfactants are derivatives of aliphatic secondary and tertiary amines containing a C8–C18 alkyl group and an aliphatic group substituted by an anionic water-solubilising group, for instance sodium 3-dodecylamino-propionate, sodium 3-dodecylaminopropane sulphonate and sodium N-2-hydroxydodecyl-N-methyl taurate.

Suitable cationic surfactants are quaternary ammonium salts having at least one C8–C22 hydrocarbon group, e.g. dodecyl-trimethylammonium bromide or chloride, cetyltrimethyl-ammonium bromide or chloride, didecyl-dimethyl-ammonium bromide or chloride. Many quaternary ammonium salts have antimicrobial properties and their use in cleaning compositions according to the invention leads to products having disinfection properties. They are used in the cleaning compositions according to the invention in an amount of 0–10%, preferably 0.1–8%, more preferably 0.5–6%

Suitable zwitterionic surfactants are derivatives of aliphatic quaternary ammonium, sulphonium and phosphonium compounds having a C8–C18 aliphatic group and an aliphatic group substituted by an anionic water-solubilising group, for instance 3-(N,N-dimethyl-N-hexadecylammonium)propane-1-sulphonate betaine, 3-(dodecyl-methyl-sulphonium)-propane-1 -sulphonate betaine and 3-(cetylmethyl-phosphonium)-ethane-sulphonate betaine.

Further examples of suitable surfactants are given in the well-known textbooks "Surface Active Agents", Volume I by Schwartz and Perry and "Surface Active Agents and Detergents", Volume II by Schwartz, Perry and Birch.

Surfactants which are storage stable in combination with the peroxygen compound may be combined with the peroxygen compound in the same partial composition. Surfactants which do not have such stability should be made part of the other partial composition or compositions. Thus, quaternary ammonium halogenides are preferably not combined with the peroxygen compound in the same partial composition because of possible decomposition of the peroxygen compound by the halogenide ion.

The partial composition containing the peroxygen bleach compound preferably also contains a sequestering agent to bind metal ions, particularly transition metal ions, which could otherwise destabilise the peroxygen compound. Suitable sequestering agents are e.g. ethylenediamine tetraacetate, amino-polyphosphonates (such as those in the DEQUEST™ range). Phosphates and a wide variety of other poly-functional organic acids and salts, can also optionally be employed. Preferred sequestering agents are selected from dipicolinic acid, ethylenediamine tetra acetic acid (EDTA) and its salts, hydroxyethylidene diphosphonic acid (Dequest 2010), ethylenediamine tetra(methylene-phosphonic acid) (Dequest 2040), diethylene-triamine penta (methylene-phosphonic acid) (Dequest 2060) and their salts. Sequestering agents are generally used in an amount of 0.01–5%, preferably 0.05–2%.

Electrolytes, particularly inorganic salts, are part of many thickening systems. Suitable salts are alkali metal carbonates, sulphates and halogenides. Halogenides are preferably kept separate from peroxygen compounds i.e. in different partial compositions. Electrolytes are used in an amount of 0–20%, preferably 0–15%, more preferably 0–10%.

Apart from sequestering agents particularly suitable for binding transition metal ions, as mentioned above, the cleaning compositions according to the invention may also usefully contain a sequestering agent suitable for binding Ca ions. Such sequestering agent may be contained in any of the partial compositions. Suitable sequestering agents for this purpose are well known in the art and include compounds such as: alkali metal tripolyphosphate, pyrophosphate and ortho-phosphate, sodium nitrilotriacetic acid salt, sodium methylglycine-diacetic acid salt, alkali metal citrate, carboxymethyl malonate, carboxymethyloxysuccinate, tartrate, mono- and di-succinate and oxydisuccinate.

As outlined above a (or the) partial composition not containing the bleach activator compound should contain sufficient alkali to raise the pH of the final composition to the level required for effective bleaching. Preferably the pH of the final composition should be 9.0 or above, more preferably at least 9.5, even more preferably at least 10.0, most preferably at least 10.5. Particularly suitable alkaline materials are alkali metal hydroxides and carbonates.

The final cleaning compositions are aqueous liquids and the partial compositions are preferably also all aqueous liquids although some or all may additionally contain organic solvent. Such organic solvents must be sufficiently stable with peroxygen bleach in order not to interfere with the cleaning process in the final composition. Also, not all thickening systems will thicken effectively in the presence of an organic solvent and therefore if thickening is required, suitable thickening systems will have to be selected. For most cleaning purposes the presence of an organic solvent will not be required. Other minor components may be present in the cleaning compositions according to the invention to improve their cleaning or disinfection properties, such as antimicrobially active compounds other than the quaternary ammonium salts mentioned above, or improve their consumer appeal. Examples of the latter are perfumes and dyes. Some perfume components, such as certail essential oils, are known in the art to have antimicrobial properties as well and so may provide a double activity.

For the purposes of the present invention a component or a partial composition will be considered to be storage stable if it still has at least 50% of its initial activity or activities after 10 days storage at 20° C. Depending on the components in the partial composition such activities may comprise: active oxygen content, bleach activator activity, surfactant activity, thickening activity, disinfecting activity, etc. For preferred storage stability the activity or activities should be at least 50% after 30 days storage, more preferably after 60 days storage at 20° C.

The compositions according to the present invention are useful as bleach compositions for a wide variety of substrates including laundry and hard surfaces. They are able to remove most types of stains. Compositions which contain a detergent surfactant are particularly useful as general purpose hard surface cleaners for surfaces such as plastic, ceramic toilet and bathroom fixtures, ceramic tiles, stainless steel and other metal surfaces, enamel, etc. On such surfaces they can not only remove stains but help in the removal of soil in general. The compositions according to the invention are particularly useful for removing black mould.

All percentages expressed herein are percentages by weight on the final composition unless indicated otherwise.

EXAMPLES

Example 1

Stability Tests of Imine Quat

The stability of N-methyl-3,4 dihydroisoquinolinium tosylate in the presence of hydrogen peroxide was tested at various pH values. To this end samples were prepared containing 6.0% w/w hydrogen peroxide, 2.0% w/w of the imine quat and 0.01% w/w Dequest™ 2047 (ethylenediamine-tetra[methylene-phosphonic acid] sodium salt, a sequestrant marketed by Monsanto). This is equivalent to a partial composition which together with a second partial composition of the same volume would lead to a final composition with 3% hydrogen peroxide and 1% imine quat.

The pH of the samples was adjusted using 1.0M hydrochloric acid or 2.0M sodium hydroxide as required. During the test the pH of the samples was re-adjusted as indicated using 2.0M sodium hydroxide.

The hydrogen peroxide content was determined by titration against 0.02 M potassium permanganate. Excess hydrogen peroxide with respect to the amount of imine quat was present thoroughout the course of each test. Complete reaction of 1 equivalent of hydrogen peroxide with 1 equivalent of imine quat would result in a decrease in hydrogen peroxide concentration of 0.2% w/w. Significant falls in hydrogen peroxide level were observed in the pH 6.5, 7.0 and 7.5 systems suggesting that reaction with imine quat is occurring.

Imine quat stability was monitored using $^{1}H$ NMR spectroscopy, by comparing the ratio of the integrals of the iminium proton which appears at 8.85 ppm relative to TMS, with those for the aromatic protons on the inert tosylate counter-ion, which are observed at 7.65 ppm. Loss of imine quat (e.g. through reaction with hydrogen peroxide) is observed as a decrease in the iminium:tosylate integral ratio, and % of imine quat remaining is calculated as integral ratio after storage÷initial integral ratio.

The results of the test are given in the table below:

| Target pH | days storage | pH | % hydrogen peroxide | % Imine Quat remaining |
|---|---|---|---|---|
| 5.5* | 0 | 5.5 | 6.00 | 100 |
| | 9 | 5.5 | | |
| | 36 | 5.5 | | |
| | 120 | 5.4 | | |
| | 148 | 5.3→5.5 | 5.99 | 93 |
| 6.0* | 0 | 6.0 | 6.00 | 100 |
| | 9 | 6.0 | | |
| | 36 | 5.9→6.0 | | |
| | 120 | 5.9 | | |
| | 148 | 5.8→6.0 | 5.95 | 83 |
| 6.5* | 0 | 6.5 | 6.00 | 100 |
| | 5 | 6.4→6.5 | | |
| | 9 | 6.4→6.5 | | |
| | 36 | 6.4→6.5 | | |
| | 120 | 6.3→6.5 | | |
| | 148 | 6.1→6.5 | 5.89 | 67 |
| 7.0* | 0 | 7.00 | 6.00 | 100 |
| | 5 | 6.8→7.0 | | |
| | 9 | 6.6→7.0 | | |
| | 36 | 6.1→7.0 | | |
| | 120 | 5.4 | | |
| | 148 | 5.01→7.0 | 5.84 | 43 |
| 7.5* | 0 | 7.5 | 6.00 | 100 |
| | 5 | 7.2→7.5 | | |
| | 9 | 6.9→7.5 | | |
| | 36 | 5.9→7.5 | | |
| | 120 | 4.3 | | |
| | 148 | 3.1→7.5 | 5.69 | 33 |

Conclusion

Up to pH 6.5 the samples survived the 50% remaining activity test for more than 148 days.

At pH 8 the imine quat was too unstable for storage: without the presence of hydrogen peroxide only 5% of the original amount remained three days after preparation of a sample containing 2% imine quat; in the presence of 6% hydrogen peroxide no imine quat was detectable one day after preparation of the sample and only 5% of the original amount was still detectable 4 hours after preparation.

Example 2

Mould Remover Composition

A mould remover composition was prepared from equal volumes of the two partial compositions A and B below (percentage w/w of the partial composition):

A 6.0% hydrogen peroxide 2.0% N-methyl-3,4-dihydroisoquinolinium tosylate 0.02% Dequest 2047 to 100% with distilled water.

pH adjusted to 5.5

B 0.4% decyldimethyl-amine oxide 0.2% lauric acid 2.4% anhydrous sodium sulphate 2.6% sodium hydroxide to 100% with distilled water pH 13.0

The partial compositions were stored separately in the compartments of a dual compartment container from which they were dispensed directly on walls infected with live black mould (*Cladosporium cladosporoides*). The final composition had pH 11 and gave good bleaching of the mould, comparable with the result obtained with conventional 3% sodium hypochlorite solution of pH 13.

Instead of sodium hydroxide equivalent amounts of an alternative source of alkalinity such as sodium carbonate can be used.

Example 3

Testing of Mould Remover Compositions on Black Mould

Hydrogen peroxide solutions with and without imine quat (N-methyl-3,4-dihydroisoquinolinium tosylate) and at various pH values were tested on their ability to bleach black mould in comparison with sodium hypochlorite, which is the standard product used to clean black mould stains. The hydrogen peroxide solutions were all freshly prepared just before testing so as to mimic compositions obtained by mixing appropriate partial compositions on dispensing. In order to obtain reproducible results an autoclaved mould paste was used for the testing.

Cultures of hyphal *Cladosporium cladosporoides* were prepared on agar jelly. Warm water was used to dissolve the jelly and separate it from the mould hyphae, which were then autoclaved. A little distilled water was added to the hyphae which were crushed to a 'paste' using a pestle and mortar. The 'paste' consists of a mixture of fine particles of hyphal cell wall together with a dark black mould ink. Once prepared the mould paste can be stored for several weeks at 5° C.

A small amount of the 'mould paste' was applied to the surface of large porous ceramic tiles and a small amount of distilled water added. This mixture was evenly spread across and rubbed into the surface of the tiles using a flexible plastic spatula. The final appearance of the soiled tiles was a uniform dark grey. The tiles were left to dry overnight in the dark and then the large tiles were cut into smaller test pieces using a standard 'tile cutter'.

Small circular pieces of single ply tissue paper were cut to a convenient size and placed on the surface of the 'mould tile' test pieces, such that the edges of the test pieces remain uncovered. A fixed quantity of the test solution was allowed to drop onto the surface of the tissue and allowed to soak into the tile. The test solution only contacted that area of the tile that was originally covered by the tissue paper, thus preserving a background of untreated 'mould paste' around the periphery of the test piece (generally 1 $cm^3$ of bleach liquor is required to cover a circular area around 3 cm in diameter). The test solution was allowed to remain in contact with the soil for a fixed contact time, i.e. 3 minutes or 20 minutes at ambient temperature, after which the test pieces were immersed in 1.0M sodium thiosulphate solution for 10 minutes (to quench the reaction and prevent further bleaching). The test pieces were then immersed in distilled water for 10 minutes before rinsing with further distilled water and air drying.

Test pieces were assessed for the level of mould bleaching by an expert panel, using a integer scale running from 0 (no decolorisation) to 6 (complete bleaching). Panel test data for each system was collated and analysed statistically to provide mean scores for each test system. Each test (bleaching) system was tested using at least 3 replicate tiles.

The test data are shown in the table below:

| | Mean score | | | |
|---|---|---|---|---|
| | 3 minutes contact time | | 20 minutes contact time | |
| System | without Imine Quat | with 1.0% Imine Quat | without Imine Quat | with 1.0% Imine Quat |
| 3.0% sodium hypochlorite, pH 13.0 | 5.2 | — | 5.5 | — |
| 3% hydrogen peroxide, pH 10.5 | 1.4 | 3.5 | 3.0 | 4.5 |
| 3% hydrogen peroxide, pH 11.0 | 2.5 | 4.0 | 3.7 | 5.2 |
| 3% hydrogen peroxide, pH 11.0 + surfactant base* | 2.4 | 4.0 | 3.8 | 5.3 |
| 3% hydrogen peroxide, pH 5.5 | — | — | 0.2 | 0.0 |

*0.2% amine oxide + 0.1% sodium laurate + 1.2% sodium sulphate as described for Example 2.

As Shown Above, Both the Hydrogen Peroxide and Hydrogen peroxide/imine quat systems were ineffective at pH 5.5. Addition of Imine Quat provided a significant improvement in performance over that from hydrogen peroxide at pH 10.5 and 11.0, with performance of the latter (after 20 minutes contact time system) closely approaching that of sodium hypochlorite.

The surfactant base system made no statistically significant contribution to the decolorisation of the mould, but is required to allow foaming on being dispensed from a dual-compartment container fitted with a suitable foam head. The foam provides sufficient cling to retain the low viscosity composition on vertical surfaces.

Example 4

Kitchen Cleaner Composition

A kitchen cleaner composition was prepared from equal volumes of the two partial compositions A and B below (percentages w/w of the partial composition):

A 6.0% hydrogen peroxide 2.0% N-methyl-3,4-dihydroisoquinolinium tosylate 0.02% Dequest 2047 to 100% with distilled water.

pH adjusted to 5.5

B 0.4% decyldimethyl-amine oxide 0.2% lauric acid 2.4% anhydrous sodium sulphate 1,5% sodium hydroxide to 100% with distilled water pH 12.5

The partial compositions were stored separately in the compartments of a dual compartment container from which they were dispensed directly on surfaces to be cleaned using a spray head. The could be dispensed as a foam or as a liquid spray, depending on the choice of spray head. The final composition had pH 10.5.

Example 5

Test of Kitchen Cleaning Model Compositions

The cleaning properties of kitchen cleaner model compositions with and without imine quat and at different pH were tested on a variety of soils as set out below:

Bleaching of Tea Stained Cotton Cloth

Tea stained cotton (BC-1) cloth is routinely used in the assessment of laundry bleaches. Here the method was adapted as an easy and readily reproducible indicator of the activity of the composition against a common hydrophilic household soil in comparison with a standard hypochlorite bleach.

Lengths of pre-stained BC-1 cotton cloth was cut into square swatches (2 cm×2 cm). For each composition four replicate cloths were placed in the bottom of a clean glass beaker and covered with the cleaning composition at room temperature. After the required contact time (generally 2 or 5 minutes) had elapsed, the cloths were removed from the cleaning solution using tweezers and immediately immersed in distilled water. The cloths were stirred in the water, and the washing procedure repeated twice more using fresh water each time. Washed cloths were then pressed between two filters to remove excess water and placed on fresh filter papers, in the dark, to dry.

Reflectance measurements were carried out on a Spectraflash 400 instrument. ΔR measurements were calculated using '40ptspec' software, using a portion of untreated cloth from the same BC-1 cloth batch as a standard. Results obtained from each of the four replicate test cloths were then statistically analysed to obtain mean ΔR values for each bleach system.

As expected, ΔR values obtained for the low pH systems were virtually zero. As the pH increases to 10.0 or higher, some activity was observed for hydrogen peroxide alone but the performance was significantly inferior to that obtained from 1% sodium hypochlorite at pH 12 (a typical concentration and alkalinity of commercial hypochlorite kitchen cleaners). Addition of Imine Quat boosts the performance of hydrogen peroxide to values very close to those observed using hypochlorite. The presence of even relatively high surfactant levels has little effect on the bleaching (decolorisation) of the stain.

The test results are shown in the table below:

| System | Mean ΔR (460 nm) 2 minutes contact time without Imine Quat | 2 minutes contact time with 1.0% Imine Quat | 5 minutes contact time without Imine Quat | 5 minutes contact time with 1.0% Imine Quat |
|---|---|---|---|---|
| 1.0% sodium hypochlorite, pH 12.0 | 25 | — | — | — |
| 3% hydrogen peroxide, pH 10.0 | 7 | 17 | 10 | 22 |
| 3% hydrogen peroxide + 3% amine oxide*, pH 10.0 | 9 | 17 | 14 | 24 |
| 3% hydrogen peroxide, pH 10.5 | 8 | 20 | 12 | 21 |
| 3% hydrogen peroxide + 3% amine oxide*, pH 10.5 | 9 | 18 | 12 | 24 |
| 3% hydrogen peroxide, pH 11.0 | 10 | 22 | — | — |
| 3% hydrogen peroxide, pH 5.5 | — | — | 0 | 1 |

* decyldimethylamine oxide

Removal of a Light Oily Kitchen Soil: Curcumin/oil on Decamel

'Curcumin/oil' is a light model kitchen soil comprising sunflower oil and curcumin (the principal pigment in curry powder).

Decamel tiles (75×75 mm Square) were cleaned using Jif™ liquid abrasive cleaner and thoroughly rinsed using distilled water and dried before application of the soil. Care was taken not to contaminate the cleaned surface, especially by touch, as otherwise red streaking occured when the soil was applied. The soil was prepared by adding 0.5 g of powdered curcumin pigment to 9.5 g of commercial sunflower oil and stirring the mixture for 5 minutes. 90 g of absolute RR ethanol was then slowly added to the mixture and the resulting solution stirred for at least 10 minutes prior to application to the substrate.

The curcumin/oil/ethanol solution was sprayed onto the vertical Decamel tiles using a 'COBALT' gravity feed spray gun (ex. SIP, 500 ml pot capacity, 1.5 mm nozzle) attached to a compressor. Care was taken to ensure even soil coverage and it was important that the curcumin/oil solution was constantly swirled whilst in the spray gun 'cup', in order to maintain a homogeneous mixture. The soiled tiles were allowed to stand for a minimum of 1 hour allowing evaporation of the ethanol solvent, producing a slightly tacky yellow coloured oil film. In daylight the colour of treated tiles fades over time (due to photo-bleaching) and soiled tiles were therefore prepared on the same day as they were used.

A circular glass ring (diameter 5 cm) was placed over the centre of a soiled tile and 5 ml of the cleaning solution was pipetted into the enclosed area. The glass template was pressed flat onto the tile surface for 30 seconds (preventing leakage of the cleaning solution) after which time the template was removed and the tile immediately rinsed under demineralised water and allowed to dry for 30 minutes. At least two replicate soiled tiles were treated with each bleach system. Experiments were carried out at ambient temperature.

The level of soil removal was visually assessed by trained panellists using a half integer scale ranging from 0 (no soil removal) to 5 (complete soil removal). The resulting data was statistically analysed to yield mean soil removal.

The results of the test are outlined in the table below:

| System (all without surfactant) | Mean score without Imine Quat | with 1.0% Imine Quat |
|---|---|---|
| Data set 1 | | |
| 3% hydrogen peroxide, pH 8.0 | 0.0 | 0.0 |
| 3% hydrogen peroxide, pH 10.5 | 2.7 | 3.8 |
| Data set 2 | | |
| 3% hydrogen peroxide, pH 10.3 | 1.5 | 1.9 |
| 3% hydrogen peroxide, pH 10.8 | 2.5 | 4.5 |

Clearly, a pH value in excess of 8, preferably >=10.5 was required for efficient cleaning.

Removal of a Tough Baked-on Soil: 'Baked Fat/flour' on Enamel

'Baked fat/flour' is a difficult to remove soil which is cooked onto enamel tiles to model pyrolised food deposits e.g. those found on cooker hobs. The soiled enamel tiles were prepared as follows:

Oleic acid (0.5 g), stearic acid (0.5 g) and Friol™ Italian Oil (190 g) were mixed in a metal beaker and directly heated, using a hotplate, to a temperature of 60° C., at which point the mixture liquefies. Demin water (500 ml) was boiled and allowed to cool to approximately 60° C. before mixing with Italian flour (200 g) to make a thick paste. The organic acid/oil mixture and the flour paste were added together and mixed together with boiling demin water (1400 ml). The whole mixture was blended until homogeneous and then warmed over a gas ring. The fat/flour mixture was allowed to simmer for three minutes with vigorous stirring and was left to stand at room temperature for 5 hours before application to the tiles.

White enamel tiles (100 mm×100 mm) were thoroughly cleaned using neat Jif™ liquid abrasive cleaner, then rinsed in demin water and allowed to dry. The tiles were coated with a thin (c.a. 0.5 mm) layer of the fat/flour mix using a screen printing technique—a flexible rubber paddle was used to spread the mix onto the tile surface, through a thin plastic mesh, taking care to achieve a uniformly thin coverage. The soiled tiles were allowed to stand in the open air for a period of between 30 minutes and 2 hours, during which time they develop a uniform matt finish. The tiles were then baked on the middle shelf of an oven at 190° C. for one hour, developing a light brown colouration.

A modified WIRA apparatus was used to clean the soil from the tiles, providing a standard mechanical 'scrubbing' action. The tiles were placed in plastic trays and clamped into the WIRA apparatus. The surface of the tile was then covered with 30 ml of the cleaning product. The WIRA cleaning head was covered with several thicknesses of dampened 'J-cloth' and used to clean the tile surface using the following settings: head weight 1.25 kg; 48 'rubs'.

After the cleaning cycle was complete, the tiles were removed from the plastic trays, rinsed with distilled water and allowed to air dry. The extent of soil removal was then visually assessed by an expert panel using a scale running from 0 (no removal) to 10 (complete removal). As bleach systems are capable of decolorising the soil without removing it, panellists were instructed to base their evaluation on the area of the shiny tile surface exposed during cleaning rather than the colour of the tile. Data was analysed statistically to calculate the mean soil removal for each system. All experiments were carried out at ambient temperature.

Some batch to batch variability in the ease of soil removal was observed so each batch was always compared with sodium hypochlorite kitchen cleaner formulation as a standard.

It was observed that the hydrogen peroxide/imine quat systems (even in the absence of surfactant) provide statistically equivalent performance to surfactant containing hypochlorite systems.

The test data obtained from two separate batches of soil are shown in the table below.

| System | Mean score | |
|---|---|---|
| | without Imine Quat | with 1.0% Imine Quat |
| Data set 1 | | |
| 1.0% sodium hypochlorite, pH 12.0 + surfactant base* | 7.1 | — |
| 3% hydrogen peroxide + 3% amine oxide**, pH 10.5 | 5.5 | 6.9 |
| Data set 2 | | |
| 1.0% sodium hypochlorite, pH 12.0 + surfactant base*** | 8.2 | — |
| 3% hydrogen peroxide, p 10.5 no surfactant | 6.5 | 8.0 |

*0.2% decyldimethylamine oxide + 0.1% sodium laurate (non-viscous)
**decyldimethylamine oxide
***1.8% dodecyldimethylamine oxide + 0.8% sodium laurate soap (viscous)

What is claimed is:

1. A liquid cleaning composition consisting of at least two liquid partial compositions which are held separate from each other in a single container comprising at least two chambers, at least one partial composition comprising a peroxygen bleach compound, characterized in that:

at least one partial composition comprises an imine or oxaziridine bleach activator compound; at least one partial composition other than that comprising the imine or oxaziridine bleach activator compound comprises an alkaline pH adjusting compound which on mixing of the partial compositions is able to raise the pH of the final composition to a value at which the combination of bleach and bleach activator is effective;

each partial composition has a pH such that the components of that partial composition are stable on storage.

2. The cleaning composition according to claim 1 characterised in that the amounts of the partial compositions are equal.

3. The cleaning composition according to claim 1 characterised in that said cleaning composition consists of two partial compositions.

4. The cleaning composition according to claim 1 characterized in that the peroxygen bleach compound is chosen from the group consisting of hydrogen peroxide, peracetic acid, N,N-phthaloylamino-peroxycapioic acid and alkali metal or alkaline earth metal monoperoxosulphate salts.

5. The cleaning composition according to claim 4 characterized in that the peroxygen bleach compound is hydrogen peroxide.

6. The cleaning composition according to claim 5 characterized in that the partial composition containing hydrogen peroxide has pH 10 or below.

7. The cleaning composition according to claim 1 characterized in that the imine or oxaziridine bleach activator compounds are chosen from the group consisting of sulfonimines, sulfonylbxaziridines, imine quaternary salts and oxaziridine quaternary salts.

8. The cleaning composition according to claim 7 characterized in that the sulfonimines have the general structure:

$$R^1R^2C{=}N{-}SO_2{-}R^3$$

wherein:

$R^1$ may be hydrogen or a substituted or unsubstituted phenyl, aryl, heterocyclic, alkyl or cycloalkyl group;

$R^2$ may be hydrogen or a substituted or unsubstituted phenyl, aryl, heterocyclic, alkyl or cycloalkyl group or a keto, carboxylic, carboalkoxy or $R^1C{=}N{-}SO_2{-}R^3$ group;

$R^3$ may be a substituted or unsubstituted phenyl, aryl, heterocyclic, alkyl or cycloalkyl group or a nitro, halo or cyano group;

$R^1$ with $R^2$ and/or $R^2$ with $R^3$ may respectively form a cycloalkyl, heterocyclic or aromatic ring system.

9. The cleaning composition according to claim 7 characterized in that the sulfonyloxaziridines have the general structure:

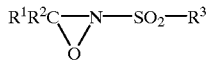

wherein:

$R^1$ may be hydrogen or a substituted or unsubstituted phenyl, aryl, heterocyclic, alkyl or cycloalkyl group;

$R^2$ may be hydrogen or a substituted or unsubstituted phenyl, aryl, heterocyclic, alkyl or cycloalkyl group or a keto, carboxylic, carboalkoxy or

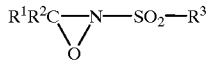

group;

$R^3$ may be a substituted or unsubstituted phenyl, aryl, heterocyclic, alkyl or cycloalkyl group or a nitro, halo or cyano group;

$R^1$ with $R^2$ and/or $R^2$ with $R^3$ may respectively form a cycloalkyl, heterocyclic or aromatic ring system.

10. The cleaning composition according to claim 7 characterised in that the imine quaternary salts have the general structure:

$$R^1R^2C{=}N^+R^3R^4X^-$$

wherein $R^1$ and $R^4$ may be hydrogen or substituted or unsubstituted phenyl, aryl, heterocyclic, alkyl or cycloalkyl groups;

$R^2$ may be hydrogen or a substituted or unsubstituted phenyl, aryl, heterocyclic, alkyl or cycloalkyl group or a keto, carboxylic or carboalkoxy group;

$R^3$ may be a substituted or unsubstituted phenyl, aryl, heterocyclic, alkyl or cycloalkyl group or a nitro, halo or cyano group;

$R^1$ with $R^2$ and/or $R^2$ with $R^3$ may respectively form a cycloalkyl, heterocyclic or aromatic ring system;

X− is a counterion which is stable in the presence of peroxide compounds.

11. The cleaning composition according to claim 7 characterised in that the oxaziridine quaternary salts have the general structure:

wherein:

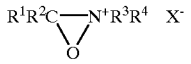

$R^1$ and $R^4$ may be hydrogen or substituted or unsubstituted phenyl, aryl, heterocyclic, alkyl or cycloalkyl groups;

$R^2$ may be hydrogen or a substituted or unsubstituted phenyl, aryl, heterocyclic, alkyl or cycloalkyl group or a keto, carboxylic or carboalkoxy group;

$R^3$ may be a substituted or unsubstituted phenyl, aryl, heterocyclic, alkyl or cycloalkyl group or a nitro, halo or cyano group;

$R^1$ with $R^2$ and/or $R^2$ with $R^3$ may respectively form a cycloalkyl, heterocyclic or aromatic ring system;

X− is a counterion which is stable in the presence of peroxide compounds.

12. The cleaning composition according to claim 10 characterised in that the imine quaternary salts are 3,4-dihydroisoquinoline salts of the general structure:

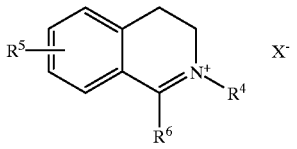

wherein $R^5$ and $R^6$ independently may be hydrogen or a substituted or unsubstituted phenyl, aryl, heterocyclic, alkyl or cycloalkyl group or a nitro, halo, cyano, alkoxy, keto, carboxylic or carboalkoxy group and X− is a peroxide stable counterion.

13. The cleaning composition according to claim 1 characterised in that the partial composition containing the bleach activator compound has a pH below 8.

14. The cleaning composition according to claim 1 characterised in that the peroxygen bleach compound and the bleach activator compound are contained in the same partial composition.

15. The cleaning composition according to claim 1 characterised in that one partial composition contains sufficient alkaline pH adjusting compound to raise the pH of the final composition to 9 or above.

16. The cleaning composition according to claim 1 characterised in that at least one partial composition contains a detergent surfactant.

17. A liquid cleaning composition having pH of 9 or above, comprising a peroxygen bleach compound and an imine or oxaziridine bleach activator compound characterized in that it is prepared by mixing partial compositions as described in claim 1.

18. A container comprising two or more chambers each provided with an outlet opening for dispensing the contents of the chamber, characterised in that the chambers hold partial compositions separately which together form a liquid cleaning composition as described in claim 1.

19. A container according to claim 18 characterised in that the number of chambers each holding a partial composition is two.

20. A container according to claim 18 characterised in that the chambers have equal volumes.

* * * * *